US007195819B2

(12) United States Patent
Hietpas et al.

(10) Patent No.: US 7,195,819 B2
(45) Date of Patent: Mar. 27, 2007

(54) BICOMPONENT FIBER AND YARN COMPRISING SAME

(75) Inventors: Geoffrey D. Hietpas, Newark, DE (US); Steven W. Smith, Waynesboro, VA (US)

(73) Assignee: Invista North America S.a.r.l., Wilmington, DE (US)

( * ) Notice: Subject to any disclaimer, the term of this patent is extended or adjusted under 35 U.S.C. 154(b) by 143 days.

(21) Appl. No.: 10/830,700

(22) Filed: Apr. 23, 2004

(65) Prior Publication Data

US 2006/0024496 A1 Feb. 2, 2006

(51) Int. Cl.
*D01F 8/00* (2006.01)

(52) U.S. Cl. ..... 428/373; 428/374; 428/370; 428/359

(58) Field of Classification Search ..... 428/359, 428/370, 373, 374, 397
See application file for complete search history.

(56) References Cited

U.S. PATENT DOCUMENTS 3,671,379 A * 6/1972 Evans et al. ..... 428/362
6,656,586 B2 * 12/2003 Hartzog et al. ..... 428/397
6,673,443 B2 * 1/2004 Koyanagi et al. ..... 428/364
2003/0056553 A1 3/2003 Hamazaki et al.
2003/0108740 A1 6/2003 Koyanagi et al.
2003/0159423 A1 8/2003 Hietpas et al.
2004/0067707 A1 4/2004 Hamilton et al.

FOREIGN PATENT DOCUMENTS

JP 2002-115149 A 4/2002
JP 2002-180332 A 6/2002
JP 2002-180333 A 6/2002

* cited by examiner

*Primary Examiner*—N. Edwards
(74) *Attorney, Agent, or Firm*—Christina W. Geerlof; Anne I. Breikss

(57) ABSTRACT

The invention provides a bicomponent staple fiber comprising poly(ethylene terephthalate) and poly(trimethylene terephthalate) wherein the bicomponent fiber has a substantially oval cross-section shape having an aspect ratio A:B of about 2:1 to about 5:1 wherein A is a fiber cross-section major axis length and B is a fiber cross-section minor axis length, a polymer interface substantially perpendicular to the major axis, a cross-section configuration selected from the group consisting of side-by-side and eccentric sheath-core, a tenacity at 10% elongation of about 1.1 cN/dtex to about 3.5 cN/dtex, a free-fiber length retention of about 40% to about 85%, and a tow crimp development value of about 30 to 55%, and a spun yarn comprising the bicomponent staple fiber.

4 Claims, 6 Drawing Sheets

BICOMPONENT FIBER AND YARN COMPRISING SAME

FIELD OF THE INVENTION

This invention relates to a polyester staple fiber, and to a spun yarn comprising such polyester staple fiber and cotton. More particularly, this invention relates to a side-by-side or eccentric sheath-core bicomponent polyester staple fiber comprising poly(ethylene terephthalate) and poly(trimethylene terephthalate) which is particularly well suited for processing on the cotton system and from which spun yarn of high uniformity and high stretch-and-recovery can be produced. This invention also relates to fabrics made from the spun yarn comprised of such bicomponent staple fiber.

BACKGROUND OF THE INVENTION

Bicomponent fibers comprising poly(ethylene terephthalate) and poly(trimethylene terephthalate) are generally known, as disclosed, for example, in U.S. Pat. Nos. 3,671,379 and 6,656,586 and in Japanese Published Patent Applications No. JP2002-180333A and JP2002-180332A, as well as in United States Published Patent Applications No. 2003/0056553 and 2003/0108740. Yarn comprising polyester fiber and cotton is disclosed in U.S. Pat. No. 6,413,631, Japanese Published Patent Application No. JP2002-115149A, and in United States Published Patent Application No. 2003/0159423 A1. However, processing these bicomponent fibers with cotton staple can be difficult and spun yarns made from these fibers in combination with cotton can have lower quality than desired. Blending of these fibers often requires reduced percentages relative to the other fiber due to deteriorating quality at increased percentage levels of bicomponent fiber. Furthermore, the processing difficulty of these fibers can limit the range of spun yarn counts that may be produced with acceptable quality.

Bicomponent fibers comprising poly(ethylene terephthalate) and poly(trimethylene terephthalate) which are better suited for processing on the cotton system are sought. High uniformity spun yarn comprising bicomponent staple fibers and cotton and having good stretch and recovery is also sought, as are stretch fabrics with uniform appearance made from cotton/polyester spun yarns.

SUMMARY OF THE INVENTION

The present invention provides a bicomponent staple fiber comprising poly(ethylene terephthalate) and poly(trimethylene terephthalate) wherein the bicomponent fiber has a substantially oval cross-section shape having an aspect ratio A:B of about 2:1 to about 5:1 wherein A is a fiber cross-section major axis length and B is a fiber cross-section minor axis length, a polymer interface substantially perpendicular to the major axis, a cross-section configuration selected from the group consisting of side-by-side and eccentric sheath-core, a tenacity at 10% elongation of about 1.1 cN/dtex to about 3.5 cN/dtex, a free-fiber length retention of about 40% to about 85%, and a tow crimp development value of about 30 to 55%.

The invention also provides a spun yarn having a cotton count of about 14 to about 60 and comprising bicomponent staple fiber comprising poly(ethylene terephthalate) and poly(trimethylene terephthalate) wherein the spun yarn has about 0.1 to about 150 thin regions per 1000 meters, about 0.1 to about 300 thick regions per 1000 meters, about 0.1 to about 260 neps per 1000 meters, and a boil-off shrinkage of about 27% to about 45%, wherein the bicomponent staple fiber is present at a level of about 30 wt % to about 100 wt %, based on total weight of the spun yarn.

The invention further provides a fabric selected from the group consisting of knits and wovens and comprising the spun yarn comprising the fiber of the invention.

DETAILED DESCRIPTION OF THE INVENTION

Figure 1A:
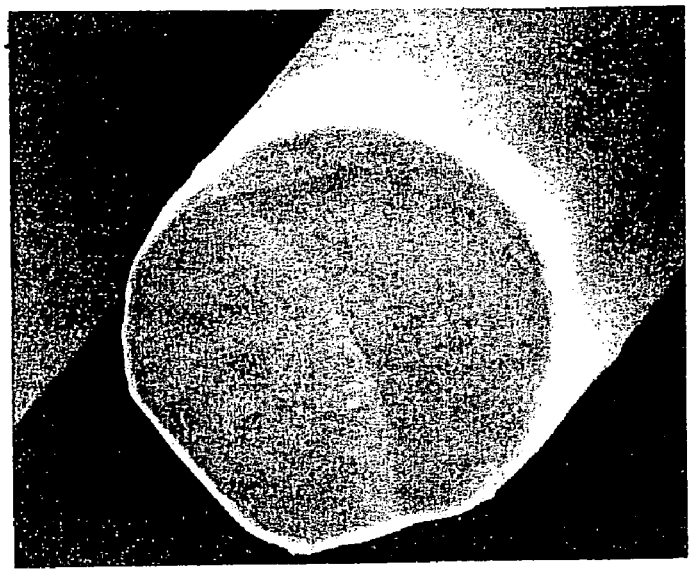
FIG. 1A is an image of a photomicrograph (3000× magnification) of a round bicomponent fiber comprising poly (ethylene terephthalate) and poly(trimethylene terephthalate).

It has now been found that bicomponent staple fiber comprising poly(ethylene terephthalate) and poly(trimethylene terephthalate) and having a certain cross-sectional shape, as well as other specific characteristics, gives spun yarns with an unexpected combination of high uniformity and high boil-off shrinkage. High boil-off shrinkage indicates that the yarn possesses high stretch-and-recovery, which is desirable for today's fabrics. Fine spun yarns are very difficult to make highly uniform, and the finding is particularly unexpected in view of the high cotton count of the spun yarn of the invention.

As used herein, "bicomponent fibers" means staple fibers in which two polymers of the same general class are in a side-by-side or eccentric sheath-core relationship.

As used herein, the term "side-by-side" means that the two components of the bicomponent fiber are immediately adjacent to one another and that no more than a minor portion of either component is within a concave portion of the other component. "Eccentric sheath-core" means that one of the two components completely surrounds the other component but that the two components are not coaxial.

As used herein, "substantially oval" means that an area of a cross-section of the fiber, measured perpendicular to the longitudinal axis of the fiber, deviates by less than about 20% from that of an oval shape. The general term "oval" includes "ovoid" (egg-shaped) and "elliptical" within its meaning. Such a shape typically has two axes at right angles through the center of the shape, a major axis (A), and a minor axis (B), where the length of the major axis A is greater than the length of the minor axis B. In the special case of a perfect ellipse, the oval is described by a locus of points whose sum of whose distances from two foci is constant and equal to A. In the more general case of an ovoid, one end of the oval can be larger than the other, so that the sum of the distances from two foci is not necessarily constant and can vary by 20% or more from elliptical. As used herein, a "substantially oval" cross-section periphery may have or may lack constant curvature.

"Aspect ratio" means the ratio of the length of the major axis of the oval to the length of the minor axis of the oval, in other words A:B.

"Polymer interface" means the boundary between the poly(ethylene terephthalate) and the poly(trimethylene terephthalate), which can be substantially linear or curved.

"Intimate blending" means the process of gravimetrically and thoroughly mixing dissimilar fibers in an opening room (for example with a weigh-pan hopper feeder) before feeding the mixture to the card or of mixing the fibers in a dual feed chute on the card. "Drawframe blending" means the process of blending carded bicomponent fiber sliver with one or more other carded fiber slivers as the slivers are being drawn on the drawframe.

The fiber of the invention has a substantially oval cross-section shape with an aspect ratio A:B of about 2:1 to about 5:1, (examples include about 2.6:1 to about 3.9:1, and about 3.1:1 to about 3.9:1). When the aspect ratio is too high or too low, the fiber can exhibit undesirable glitter and low dye yield, and spun yarn comprising the fiber can be insufficiently uniform. The fiber also has a polymer interface substantially perpendicular to the major axis of the cross-section, and a free-fiber length retention from about 40% to about 85%. Such oval filaments can be spun from spinneret orifices that are slot-shaped (flat or with side bulges), oval, and the like.

The oval cross-section shape is substantially free of grooves in the cross-section periphery. That is, there is only one maximum when the length of the minor axis is plotted against the length of the major axis. Examples of cross-section shapes which do have grooves are "snowman", "scalloped oval", and "keyhole" cross-sections.

The fiber comprises two polyesters, for example poly (ethylene terephthalate) and poly(trimethylene terephthalate), preferably of different intrinsic viscosities, although different combinations such as poly(ethylene terephthalate) and poly(tetrabutylene terephthalate) are also possible. Alternatively, the compositions can be similar, for example a poly(ethylene terephthalate) homopolyester and a poly (ethylene terephthalate) copolyester, optionally also of different viscosities.

The bicomponent fiber has a free fiber length retention of about 40% to about 85%. The free fiber length retention is a useful measure of how "straight" the crimped fiber is in its relaxed state, in other words, how tightly the crimped fiber coils when it is not under tension. A spun yarn comprising a bicomponent staple fiber having a free fiber length retention that is too low can exhibit poor uniformity, and can be difficult to card.

The bicomponent staple fiber can have a tenacity-at-break of about 3.6 to about 5.0 cN/dtex, tenacity at 10% elongation (T10) of about 1.1 cN/dtex to about 3.5 cN/dtex (preferably about 2.0 to 3.0 cN/dtex), and a weight ratio of poly (ethylene terephthalate) to poly(trimethylene terephthalate) of about 30:70 to about 70:30, preferably about 40:60 to about 60:40. When the tenacity-at-break is too low, the fiber can break during carding. When the tenacity-at-break is too high, fabrics comprising the fiber can exhibit undesirable pilling.

One or both of the polyesters comprising the fiber of the invention can be copolyesters, and "poly(ethylene terephthalate)" and "poly(trimethylene terephthalate)" include such copolyesters within their meanings. For example, a copoly(ethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclo-hexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl) ether, or a poly(ethyleneether) glycol having a molecular weight below about 460, including diethyleneether glycol). The comonomer can be present to the extent that it does not compromise the benefits of the invention, for example at levels of about 0.5–15 mole percent based on total polymer ingredients. Isophthalic acid, pentanedioic acid, hexanedioic acid, 1,3-propane diol, and 1,4-butanediol are preferred comonomers.

The copolyester(s) can also be made with minor amounts of other comonomers, provided such comonomers do not have an adverse effect on the physical properties of the fiber. Such other comonomers include 5-sodium-sulfoisophthalate, the sodium salt of 3-(2-sulfoethyl) hexanedioic acid, and dialkyl esters thereof, which can be incorporated at about 0.2–4 mole percent based on total polyester. For improved acid dyeability, the (co)polyester(s) can also be mixed with polymeric secondary amine additives, for example poly(6,6'-imino-bishexamethylene terephthalamide) and copolyamides thereof with hexamethylenediamine, preferably phosphoric acid and phosphorous acid salts thereof. Small amounts, for example about 1 to 6 milliequivalents per kg of polymer, of tri- or tetra-functional comonomers, for example trimellitic acid (including precursors thereto) or pentaerythritol, can be incorporated for viscosity control.

The fiber of the present invention can also comprise conventional additives such as antistats, antioxidants, antimicrobials, flameproofing agents, dyestuffs, light stabilizers, and delustrants such as titanium dioxide, provided they do not detract from the benefits of the invention.

After the fibers have been drawn and heat-treated, it is advantageous to apply a finish to the bicomponent fibers, for example to the tow before cutting it to staple. The finish can be applied at a level (% by total weight) of 0.05–0.30%. The finish can comprise 1) a blend of alkyl or branched phosphate esters, or 2) the potassium, calcium, or sodium salts of the corresponding phosphate acids, or a blend of the those two classes in any proportion, each of which can contain from 6 to 24 total carbon atoms in the aliphatic segments. The finish can also contain poly(ethylene oxide) and/or poly(propylene oxide), or short chain segments of such polyethers can be attached by esterification to aliphatic acids such as lauric acid, or by an ether linkage to alcohols such as sorbitol, glycerol, castor oil, coconut oil, or the like. Such compounds can also comprise amine groups. The finish can also contain minor amounts (for example <10%) of functional additives such as silicones or fluorochemicals. The finish can contain a blend of the potassium salts of mono- and di-acids containing about 18 carbons and an ethoxylated polyether containing 4–10 ethylene oxide segments made by reaction of an n-alkyl alcohol containing from 12 to 18 carbon atoms with a blend of polyethers.

It is unnecessary that the crimps of the bicomponent fibers in the tow precursor to the staple fiber be deregistered, that is treated in such a way as to misalign the crimps of the fibers. Similarly, the bicomponent staple tow does not require mechanical crimping in order for staple made therefrom to display good processability and useful properties.

The bicomponent fiber can have an elongation to break of about 15% to about 35%, for example about 15% to about 25%, and typically of about 15% to about 20%.

The bicomponent staple fiber can have a tow crimp development ("CD") value of about 30% to about 55% and a crimp index ("CI") value of about 15% to about 25%. When the CD is lower than about 30%, a spun yarn comprising the fiber typically has too little total boil-off shrinkage to generate good recovery in fabrics made therefrom. When the CI value is low, mechanical crimping can be necessary for satisfactory carding and spinning. When the CI value is high, the bicomponent staple can have too much crimp to be readily cardable, and the uniformity of the spun yarn can be inadequate. When CI is lower in the range of acceptable values, higher proportions of polyester bicomponent staple fibers can be used without compromising cardability and yarn uniformity. When CD is higher in the range of acceptable values, lower proportions of bicomponent staple can be used without compromising total boil-off shrinkage.

The bicomponent staple fiber can have a length of about 1.3 cm to about 5.5 cm. When the bicomponent fiber is shorter than about 1.3 cm, it can be difficult to card, and when it is longer than about 5.5 cm, it can be difficult to spin on cotton system equipment. The cotton can have a length of from about 2 to about 4 cm. The bicomponent fiber can have a linear density of about 0.7 dtex, preferably about 0.9 dtex, to about 3.0 dtex, preferably to about 2.5 dtex. When the bicomponent staple has a linear density above about 3.0 dtex, the yarn can have a harsh hand, and it can be hard to blend with the cotton. When it has a linear density below about 0.7 dtex, it can be difficult to card.

The spun yarn of the invention has a cotton count of about 14 to about 60 (preferably about 16 to about 40) and comprises a bicomponent staple fiber comprising poly(ethylene terephthalate) and poly(trimethylene terephthalate) and a second staple fiber selected from the group consisting of cotton (preferred), synthetic cellulosic, and acrylic fibers. The spun yarn is very uniform and has about 0.1 to about 150 (preferably about 1 to 70) thin regions per 1000 meters, about 0.1 to about 300 thick regions per 1000 meters, about 0.1 to about 260 neps per 1000 meters, and a total boil-off shrinkage of about 27% to about 45%, for example about 30% to about 45%. When the total boil-off crimp shrinkage is less than about 27%, the stretch-and-recovery properties of the yarn are too low when the yarns are woven or knitted into fabrics.

Yarn quality factor is a very useful measure of yarn quality, which can be calculated from the number of thin regions, thick regions, neps, coefficient of variation of mass, and yarn strength. The spun yarn can have a yarn quality factor of about 0.1 to about 650, for example about 1 to about 300. When the quality factor is too high, the yarn can be insufficiently uniform.

Another way to describe uniformity of spun yarn is in terms of the coefficient of variation as determined with a Uniformity 1-B Tester. The spun yarn of the invention can have a coefficient of variation of mass of about 10% to about 18%, for example about 12% to about 16%.

It is preferred that the spun yarn of the invention comprise the fiber of the invention, and that the spun yarn have a tenacity-at-break of about 10 to about 22 cN/tex. When the tenacity is too low, yarn spinning can be difficult and weaving efficiency and fabric strength can be reduced. It is also preferred that the linear density of the spun yarn be about 100 to about 700 denier (111 to 778 dtex).

In the spun yarn, the bicomponent staple fiber is present at a level of about 30 wt % to about 100 wt %, based on the total weight of the spun yarn. When the yarn of the invention comprises less than about 30 wt % polyester bicomponent, the yarn can exhibit inadequate stretch and recovery properties. When the bicomponent staple fiber is present at a level below 100 wt % but above 30 wt %, the spun yarn comprises a second staple fiber selected from the group consisting of monocomponent poly(ethylene terephthalate), monocomponent poly(trimethylene terephthalate), cotton, wool, acrylic, and nylon staple fibers which can be present at about 1 wt % to about 70 wt %, based on total weight of the spun yarn. Optionally, the spun yarn of the invention can further comprise a third staple fiber selected from the same group and present at about 1 wt % to about 69 wt % based on the total weight of the spun yarn; together, the second and third staple fibers can be present at about 1 wt % to about 70 wt %, based on total weight of the spun yarn.

The yarn may be spun by commercially available processes such as ring, open end, air jet, and vortex spinning.

Knit and woven stretch fabrics can be made from the spun yarn of the invention. Stretch fabric examples include circular, flat, and warp knits, and plain, twill, and satin wovens. The high uniformity and stretch characteristics of the spun yarn are typically carried through into the fabric as uniform appearance and high stretch and recovery, which are highly desirable.

Test Methods

Intrinsic viscosity ("IV") of the polyesters was measured with a Viscotek Forced Flow Viscometer Model Y-900 at a 0.4% concentration at 19° C. and according to ASTM D-4603-96 but in 50/50 wt % trifluoroacetic acid/methylene chloride instead of the prescribed 60/40 wt % phenol/1,1,2,2-tetrachloroethane. The measured viscosity was then correlated with standard viscosities in 60/40 wt % phenol/1,1,2,2-tetrachloroethane to arrive at the reported intrinsic viscosity values.

Linear density and tensile properties of the fibers were measured with a Favimat instrument from Textechno (Germany) in accordance with ASTM methods D1577 for linear density and D3822 for tenacity and elongation. Measurements were done on a minimum of 25 fibers and averages are reported.

Within each bicomponent staple fiber sample, the fibers had substantially equal linear densities and polymer ratios of poly(ethylene terephthalate) to poly(trimethylene terephthalate). No mechanical crimp was applied to the bicomponent staple fibers in the Examples.

Finish levels are given as wt % finish on fiber and were obtained on bicomponent fiber cut from the tow, using methanol to extract the finish oils from the fiber, evaporating the methanol, and then gravimetrically determining the weight of the finish so extracted. Weight percent finish was calculated as shown in Formula I:

$$\text{wt \% finish} = \frac{100 \times (\text{weight of finish})}{(\text{weight of finish} + \text{weight of fiber})} \quad \text{(I)}$$

To determine free-fiber length retention, the fibers, which had not yet been heat-treated to develop crimp fully, were extended just enough to remove the low level of crimp already present and cut to length $L_1$ (38 mm in the Examples). When cut, the fibers retracted to their free (relaxed) length $L_2$ and regained their crimp. The free length $L_2$ was measured from an assembly of cut fibers under zero tension with a ruler, the measurement was repeated three times, and the results were averaged. Free-fiber length retention was calculated by dividing the free fiber length $L_2$ by the extended fiber length $L_1$ and expressing the result as a percentage, as indicated by Formula II:

$$\text{free-fiber length retention} = (L_2/L_1) \times 100 \quad \text{(II)}$$

Figure 2A:
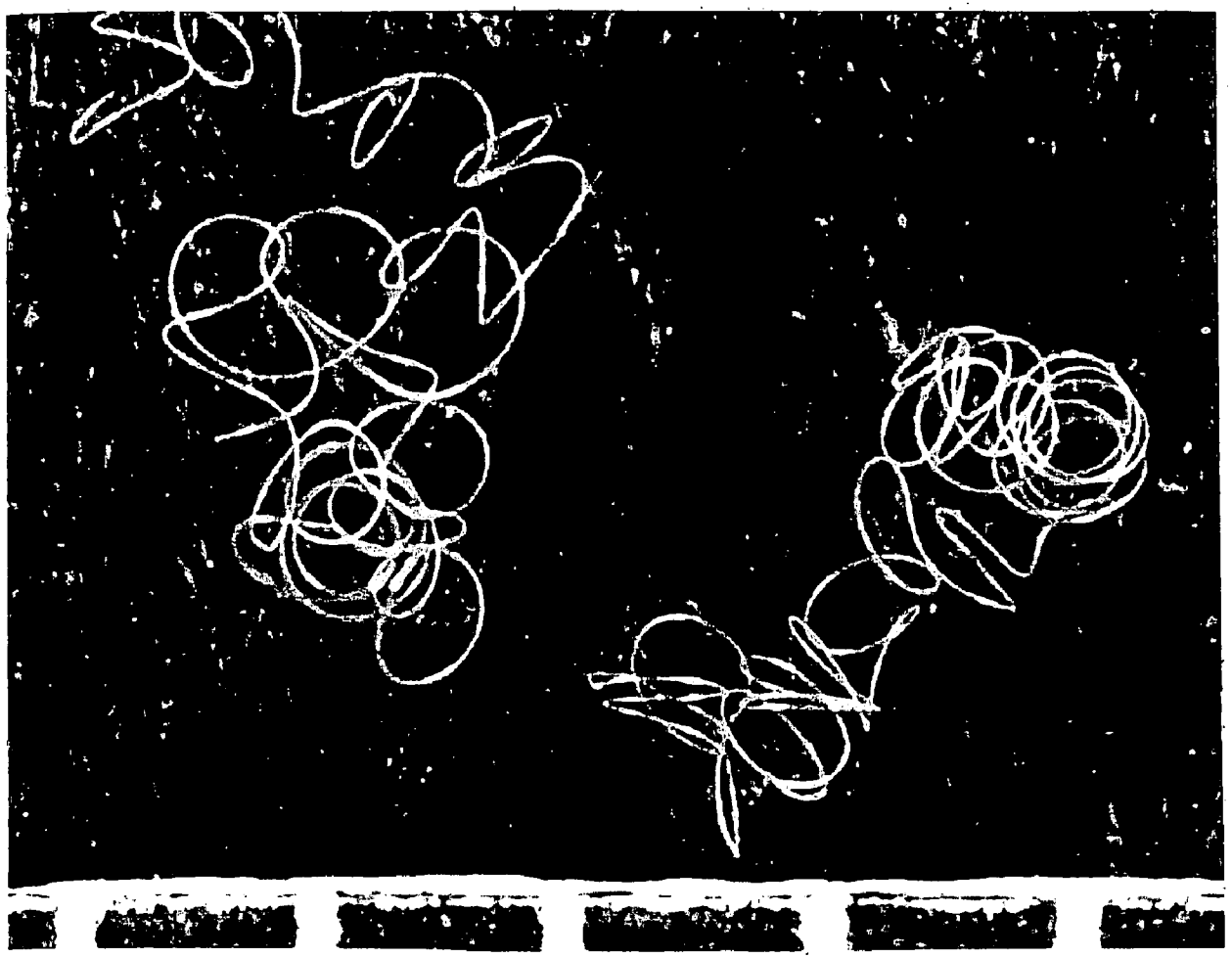
FIG. 2A is an image of a photomicrograph (32× magnification) of a bicomponent fiber comprising poly(ethylene terephthalate) and poly(trimethylene terephthalate) having a round cross-section.
Figure 2B:
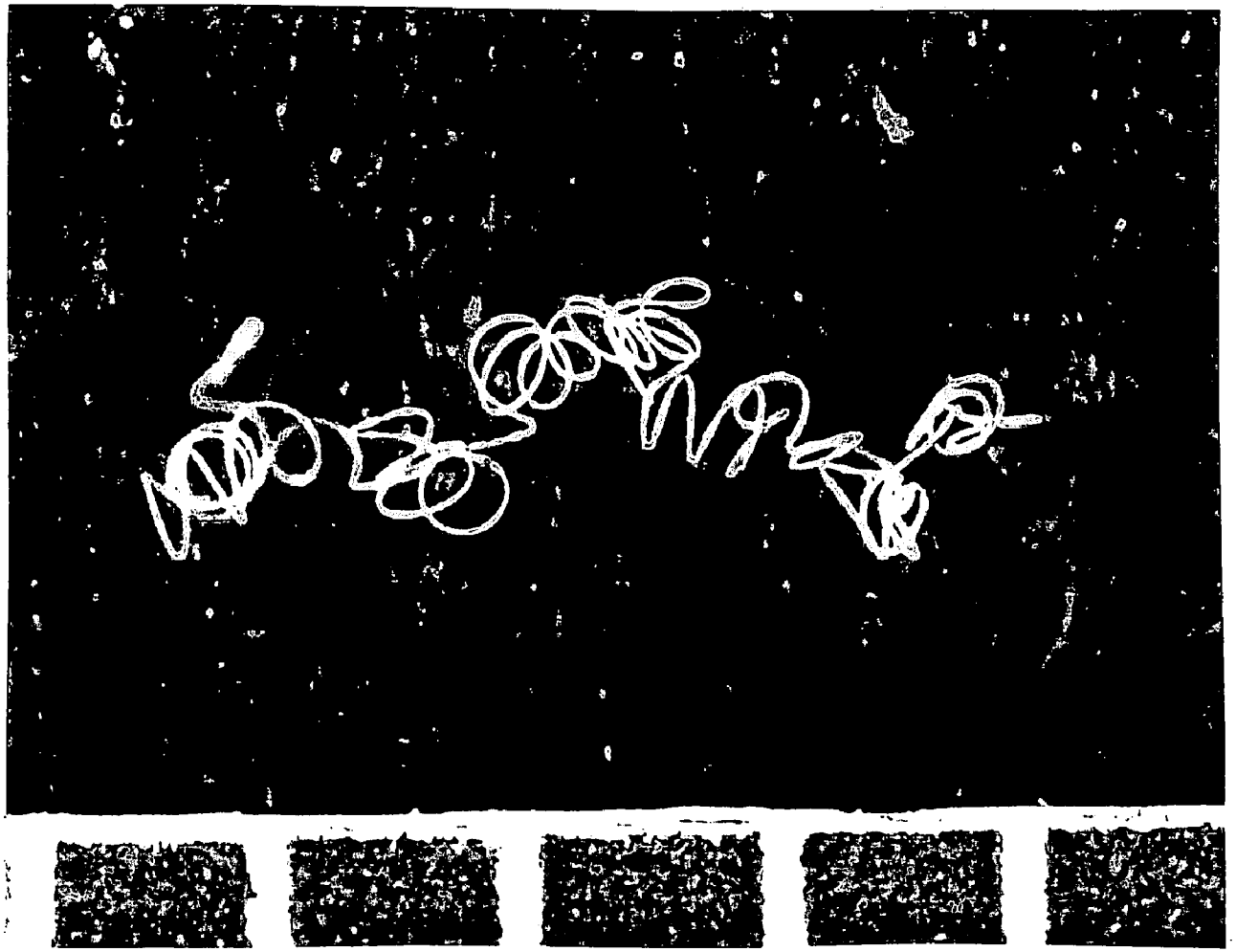
FIG. 2B is an image of a photomicrograph (32× magnification) of a bicomponent fiber comprising poly(ethylene terephthalate) and poly(trimethylene terephthalate) having a scalloped oval cross-section with polymer interface parallel to the major axis.
Figure 2C:
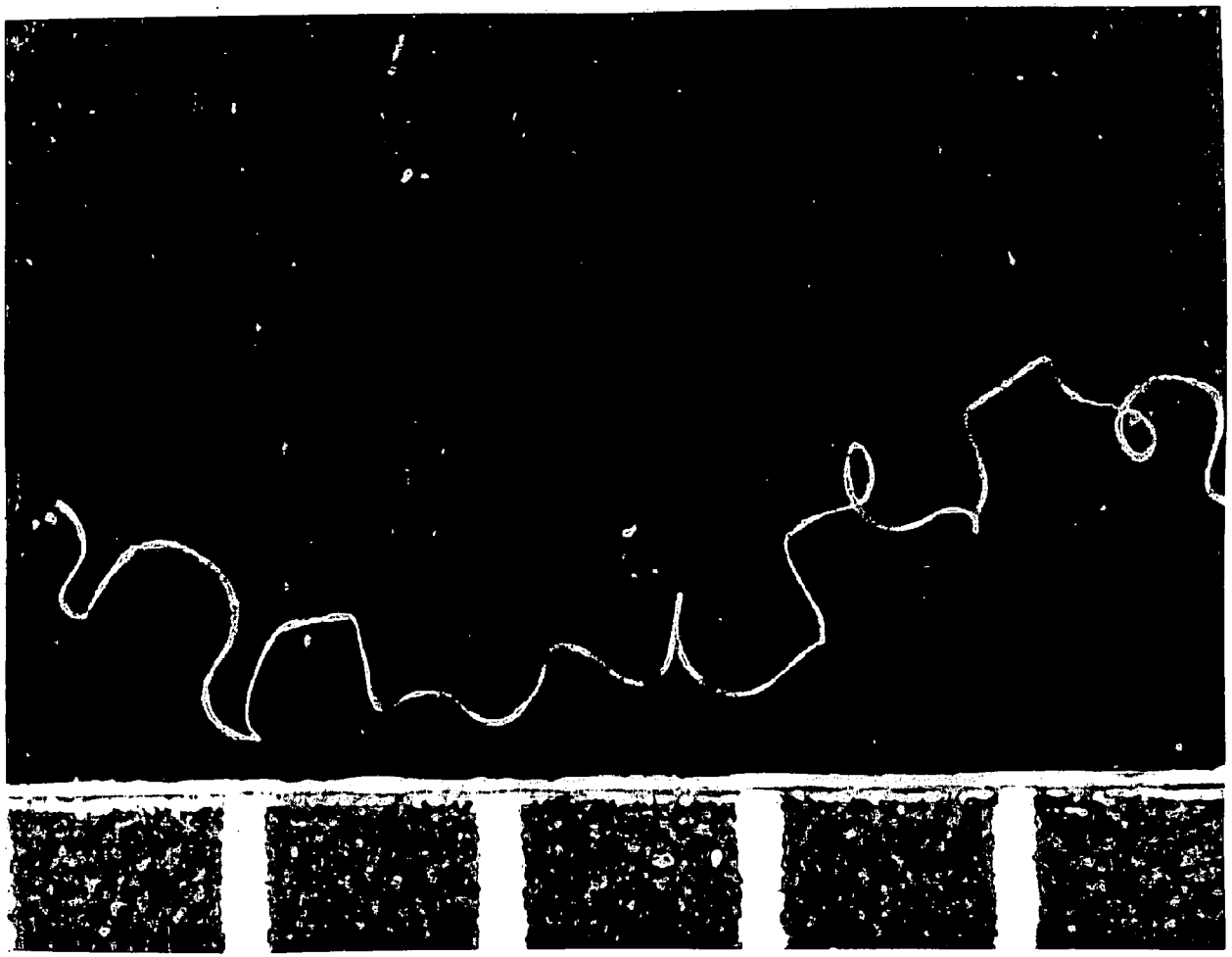
FIG. 2C is an image of a photomicrograph (32× magnification) of a preferred embodiment of the bicomponent fiber of the invention having an "oval" cross-section with an aspect ratio of about 3.3:1.

FIG. 2 qualitatively illustrates the difference in free-fiber length retention between fibers not of the invention (FIGS. 2A and 2B) and a fiber of the invention (FIG. 2C).

Unless otherwise noted, the following methods of measuring tow Crimp Development and tow Crimp Index of the bicomponent fiber were used in the Examples. The methods described here are numerically equivalent to the methods used in United States Published Patent Application No. 2003/0159423 A1. Minor modifications are indicated here which improve operational efficiency. To measure tow Crimp Index ("CI"), a 1.2-meter sample of polyester bicomponent tow was weighed, and its denier was calculated; the tow linear density was typically about 40,000 to 50,000 denier (44,000 to 55,000 dtex). A single knot was tied at each end of the tow. Tension was applied to the vertical tow sample by applying a first clamp at the lower knot and hanging at least 40 mg/den (0.035 dN/tex) of weight on the knot at the upper end of the tow, which was directed over a stationary roller located at 1.1 m from the bottom end of the tow. The weight was selected so as to straighten the crimp from the tow without breaking the fibers. At this point the tow was essentially straight and all fiber crimp was removed. Then, a second clamp was applied to the tow 100 cm above the first clamp while the weight was in place. Next, the weight at the upper end of the tow was removed, and a 1.5 mg/den (0.0013 dN/tex) weight was attached to the tow just below the lower knot, the first clamp was removed from the lower knot, and the sample was allowed to retract against the 0.0013 dN/tex weight. The length of the retracted tow from the second clamp to the lower knot was measured in centimeters and identified as Lr. C.I. was calculated according to Formula III. To measure tow Crimp Development ("CD"), the same procedure was carried out, except that the 1.2-meter sample was placed—unrestrained—in an oven at 105° C. for 5 minutes, then allowed to cool at room temperature for at least two minutes before beginning the measuring procedure.

$$CI \text{ and } CD\ (\%) = 100 \times (100\ \text{cm} - Lr)/100\ \text{cm} \quad \text{(III)}$$

Because merely cutting the tow into staple fibers does not affect the crimp, it is intended and is to be understood that references herein to crimp values of staple fibers indicate measurements made on the tow precursors to such fibers.

Cardability of staple fibers which contained adequate finish to control static was evaluated by visual inspection of the card web and the coiling of the sliver. Fibers which produced a card web which was uniform in appearance and free of neps, and which had no coiler chokes during processing into sliver, were considered to exhibit good cardability. Fibers which did not meet these criteria were considered to have poor cardability.

To determine the total boil-off shrinkage ("B.O.S.") of the spun yarns in the Examples, the yarn was made into a skein of 25 wraps on a standard skein winder. While the sample was held taut on the winder, a 10 inch (25.4 cm) length ("$L_0$") was marked on the sample with a dye marker. The skein was removed from the winder, placed in boiling water for 1 minute without restraint, removed from the water, and allowed to dry at room temperature. The dry skein was laid flat, and the distance between the dye marks was again measured ("$L_{bo}$"). Total boil-off shrinkage was calculated from Formula IV:

$$\text{Total } B.O.S\ (\%) = 100 \times (L_0 - L_{bo})/L_0 \quad \text{(IV)}$$

Using the same sample that had been subjected to the boil-off total shrinkage test, the 'true' shrinkage of the spun yarn was measured by applying a 200 mg/den (0.18 dN/tex) load, measuring the extended length, and calculating the percent difference between the before-boil-off and extended after-boil-off lengths. The true shrinkage of the samples was generally less than about 5%. Since true shrinkage constitutes only a very minor fraction of total boil-off shrinkage, the latter is used herein as a reliable measure of the stretch-and-recovery characteristics of the spun yarns. Higher total boil-off shrinkage corresponds to desirably higher stretch-and-recovery.

Yarn count is a term commonly used to describe the linear density of a spun yarn.

The uniformity of the spun yarns along their length was determined with a Uniformity 1-B Tester (made by Zellweger Uster Corp.) and reported as Coefficient of Variation ("CV") in percentage units. In this test, yarn was fed into the Tester at 400 yds/min (366 m/min) for 2.5 minutes, during which the mass of the yarn was measured approximately every 8 mm. The standard deviation of the resulting data was calculated, multiplied by 100, and divided by the average mass of the yarn tested to arrive at percent CV. The Uniformity 1-B tester also determined an average numerical count of the number of thick regions, thin regions, and neps per 1000 yards of yarn. Thick regions in the yarn are those places having a mass at least 50% greater than the average mass. Thin regions in the yarn are those places having a mass at least 50% lower than the average mass. Neps are those places in the yarn having a mass at least 200% more than the average mass.

Spun yarn tensile properties were determined using a Tensojet (also made by Zellweger Uster Corp.). Tenacities are reported as cN/tex.

Yarn Quality Factor was calculated as shown in Formula V:

$$\text{Yarn Quality Factor} = ([E + F + G]J \times H)/J \quad \text{(V)}$$

wherein

E is the number of thick regions per 1000 yards of yarn,

F is the number of thin regions per 1000 yards of yarn,

G is the number of neps per 1000 yards of yarn,

H is the coefficient of variation of yarn mass ("CV") in percentage units, each as measured by the Uster Uniformity 1-B tester, and J is the tenacity-at-break of the yarn in cN/tex.

In Example 1 and Comparison Examples 1, 2, 3, and 4, the ratio of first draw ratio to total draw ratio was 0.78 to 0.88, and the duration of the heat-treating step was at least 3 seconds. Cross-section aspect ratios A:B were determined by measurement of photomicrographs and were typically accurate to within 5%. Fiber preparation conditions and properties not described in the text are presented in Tables 1 and 2, respectively.

In the Tables, "Comp." indicates a Comparison Example, "B.O.S." means boil-off shrinkage, "Ne" means cotton count (English), "nm" indicates "not measured," "CV" means the coefficient of variation of mass as measured by the Uster Uniformity 1-B tester, "T10" refers to the tenacity of the bicomponent fiber at 10% elongation, "let-down ratio" means the ratio of puller roll speed to last draw roll speed, and "Bico." means bicomponent. "Thicks" refers to the number of places per 1000 yards of yarn having a mass at least 50% greater than the average mass; "thins" refers to the number of places per 1000 yards of yarn having a mass at least 50% lower than the average mass. "Neps" refers to the number of places per 1000 yards of yarn having a mass at least 200% more than the average mass. The number of thicks, thins, and neps reported is as measured by the Uster Uniformity 1-B tester.

EXAMPLES

Example 1A

Continuous bicomponent filaments of poly(ethylene terephthalate) (T211 from Intercontinental Polymers, Inc., 0.56 dl/g IV), and Sorona® brand poly(trimethylene terephthalate) (Sorona® is a registered trademark of E.I. DuPont de Nemours and Company) having an IV of 0.98 dl/g, were extruded in a 50/50 weight ratio from a block operated at 272° C. via metering pumps to a bicomponent spin pack provided with etched metering plates which joined the polymer streams directly above the counterbore of the spinneret capillaries. A delusterant of particulate $TiO_2$ was added to both polymers at a level of 0.1–0.4% by weight. The polymers were spun from a 288-hole spinneret in which the capillaries were 0.38 mm in depth and had cross-sections that were 0.64 mm long modified slots, with outward-rounded bulges in the middle of each long side (maximum width 0.18 mm) and rounded ends with 0.06 mm radii. The polymer interface was substantially perpendicular to the major axis of the resulting oval cross-section fiber.

Figure 1B:
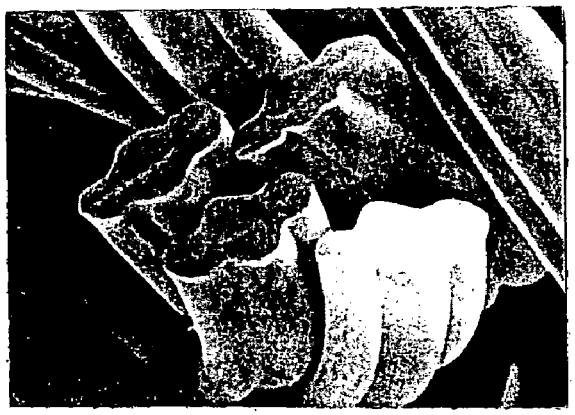
FIG. 1B is an image of a photomicrograph (1000× magnification) of a bicomponent fiber comprising poly(ethylene terephthalate) and poly(trimethylene terephthalate) having a "scalloped oval" cross-section wherein the polymer interface is parallel to the major axis.
Figure 1C:
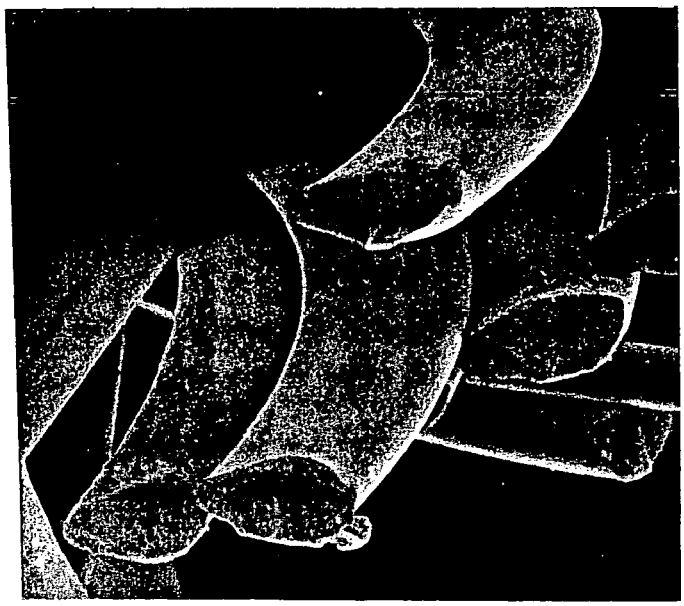
FIG. 1C is an image of a photomicrograph (1000× magnification) of an embodiment of the bicomponent fiber of the invention having an "oval" cross-section with an aspect ratio of about 2.1:1.

The just-spun fibers were cooled with a cross-flow of air applied at a mass ratio (air/polymer) of about 10–14, spin finish was applied with a metered contact applicator at 0.1 wt %, and the oval (aspect ratio of 2.1:1 (measured—see FIG. 1C) fibers were wound up on bobbins at 1000 m/min.

Fibers from a plurality of bobbins were combined into a tow of approximately 50,000 dtex and drawn in two stages using first and second draw ratios of 2.69 and 1.28, respectively, with a final speed of 50 m/min. The first draw was performed at 35° C. in a water bath, and the second draw, under a hot-water spray at 90° C. The drawn tow was heat-treated at 150° C., cooled to below 30° C. with a dilute finish oil/water spray (0.20 wt % on fiber), and passed to a puller roll operated at a slower speed than the last draw roll. The tow was dried at room temperature and cut to 1.5" (3.8 cm) staple length.

Example 1B

Figure 1D:
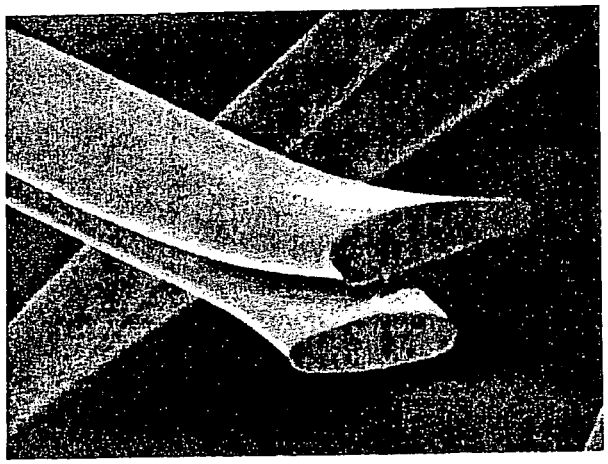
FIG. 1D is an image of a photomicrograph (1000× magnification) of a preferred embodiment of the bicomponent fiber of the invention having an "oval" cross-section with an aspect ratio of about 3.5:1.

Polyester bicomponent staple fiber was made as described in Example 1A, with the following differences. Oval fibers of aspect ratio 3.3:1 (measured—see FIG. 1D) were spun from a 288-hole spinneret in which the capillaries were 0.38 mm in depth and had cross-sections that were 0.76 mm long modified slots, with outward-rounded bulges in the middle of each long side (maximum width 0.14 mm) and rounded ends with 0.05 mm radii. Let-down ratio was 0.942. FIG. 2C illustrates the low coiling exhibited by the fiber.

Example 1C

Polyester bicomponent staple fiber was made as described in Example 1A, with the following differences. The poly (ethylene terephthalate) IV was 0.54, and the poly(trimethylene terephthalate) IV was 0.95. The fiber cross-section was oval with an aspect ratio of 2.4:1 (measured), the spin speed was 1200 m/min, the first draw ratio was 2.23, the heat-treating temperature was 170° C.

Example 1D

Polyester bicomponent staple fiber was made as described in Example 1A, with the following differences. Oval fibers of aspect ratio of about 3:1 (estimated) were spun through the orifices of Example 1B. The poly(ethylene terephthalate) IV was 0.54, the poly(trimethylene terephthalate) IV was 0.95, the spinning speed was 1200 m/min, the first draw ratio was 2.44, and the heat-treating temperature was 170° C.

Example 1E

Polyester bicomponent staple fiber was made as described in Example 1D, with the following differences. Oval fibers of aspect ratio 3.3:1 (measured) were spun, the first draw ratio was 2.52, and let-down ratio was 0.97.

Example 1F

Polyester bicomponent staple fiber was made as described in Example 1D, except that the first draw ratio was 2.54 and the heat-treating temperature was 165° C.

Example 1G

Polyester bicomponent staple fiber was made as described in Example 1D, with the following differences. Oval fibers of aspect ratio 3.5:1 (measured) were spun, the first draw ratio was 2.56, and the heat-treating temperature was 165° C. The low T10 value obtained indicated that the target letdown ratio of 1.0 was not achieved. The actual letdown ratio was below 1.0.

Example 1H

Polyester bicomponent staple fiber was made as described in Example 1B, with the following differences. Oval fibers of aspect ratio about 3:1 (estimated) were spun. The weight ratio of the polymers was 55/45 poly(ethylene terephthalate)/poly(trimethylene) terephthalate, the poly(trimethylene terephthalate) IV was 0.94, the poly(ethylene terephthalate) was KoSa 8958C, the spinning speed was 1400 m/min, the first draw ratio was 2.37, the second draw ratio was 1.29, and the heat-treating temperature was 180° C.

COMPARISON EXAMPLES

Comparison Example 1

Figure 3:
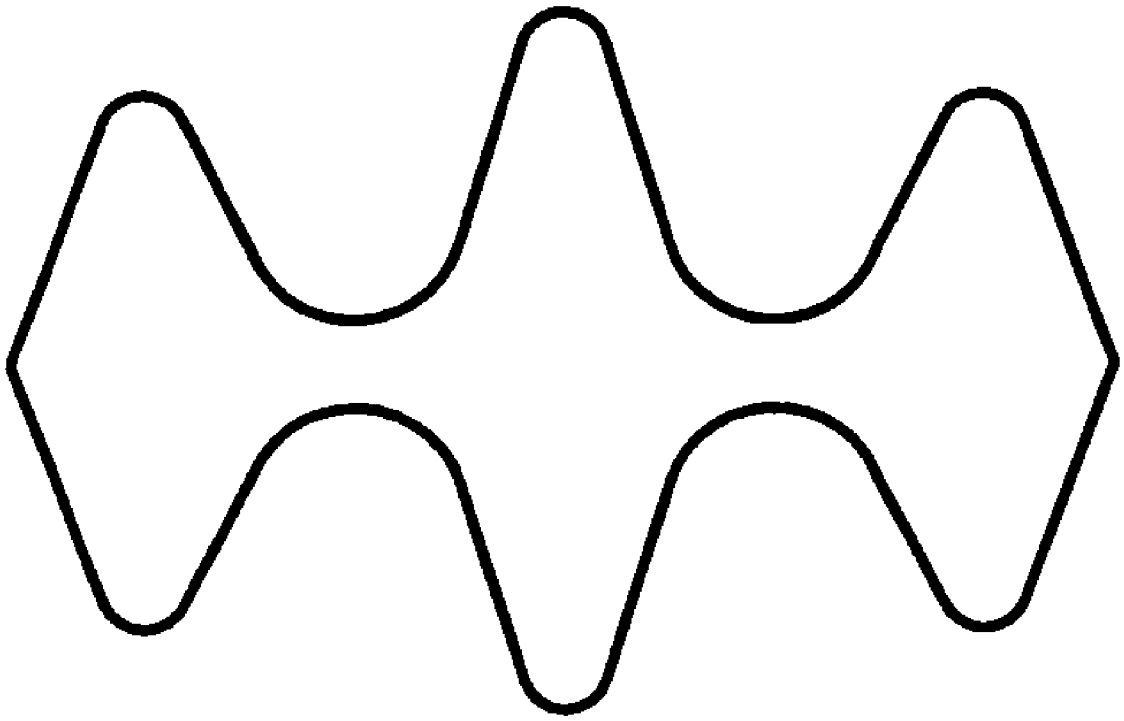
FIG. 3 shows a typical spinneret orifice for spinning fibers with scalloped oval cross-section.

Polyester bicomponent staple fiber was made as described in Example 1A, with the following differences. Scalloped oval (measured aspect ratio 2.2:1—see FIG. 1B) fibers with the polymer interface parallel to the major axis of the cross-section were spun through orifices of configuration essentially as shown in FIG. 3. The orifices were arranged to give the desired interface orientation. The poly(trimethylene terephthalate) IV was 1.04, the first draw ratio was 2.71, and let-down ratio was 0.85. FIG. 2B illustrates the excessive coiling exhibited by the fiber.

Comparison Example 2

Polyester bicomponent staple fiber was made as described in Example 1A, with the following differences. Round fibers (see FIG. 1A) were extruded through circular orifices of diameter 0.36 mm. The first draw ratio was 2.91, the second draw ratio was 1.13, and let-down ratio was 0.85. FIG. 2A illustrates the excessive coiling exhibited by the fiber.

TABLE 1

| Example | Cross-section Shape | Capillary Throughput (g/min) | Total Draw Ratio | Let-down Ratio |
|---|---|---|---|---|
| 1A | 2.1:1 oval | 0.50 | 3.44 | 0.860 |
| 1B | 3.3:1 oval | 0.50 | 3.44 | 0.942 |
| 1C | 2.4:1 oval | 0.52 | 2.85 | 0.970 |
| 1D | about 3:1 oval | 0.52 | 3.12 | 0.980 |
| 1E | 3.3:1 oval | 0.42 | 3.23 | 0.970 |
| 1F | about 3:1 oval | 0.36 | 3.25 | 0.995 |
| 1G | 3.5:1 oval | 0.43 | 3.28 | 1.000 |
| 1H | about 3:1 oval | 0.55 | 3.06 | 1.010 |
| Comp. Example 1 | scalloped oval | 0.50 | 3.47 | 0.850 |
| Comp. Example 2 | round | 0.50 | 3.29 | 0.850 |

The data in Table 2 also show that the fibers of the invention have very good cardability and fibers not of the invention have poor cardability.

Comparison Example 3

Polyester bicomponent staple fiber was made from bicomponent continuous filaments of poly(ethylene terephthalate) (Crystar® 4415-763, a registered trademark of E. I. du Pont de Nemours and Company), having an intrinsic viscosity ("IV") of 0.52 dl/g, and Sorona® brand poly(trimethylene terephthalate) (Sorona® is a registered trademark of E. I. DuPont de Nemours and Company), having an IV of 1.00, which were melt-spun through a 68-hole post-coalescing spinneret at a spin block temperature of 255–265° C. The weight ratio of the polymers was 60/40 poly(ethylene terephthalate)/poly(trimethylene terephthalate). The filaments were withdrawn from the spinneret at 450–550 m/min and quenched with crossflow air. The filaments, having a 'snowman' cross-section, were drawn 4.4×, heat-treated at 170° C., interlaced, and wound up at 2100–2400 m/min. The filaments had 12% CI, 51% CD, and a linear density of 2.4 dtex/filament. For conversion to staple fiber, filaments from wound packages were collected into a tow and fed into a conventional staple tow cutter, the blade spacings of which were adjusted to obtain a 1.5 inch (3.8 cm) staple length.

Comparison Example 4

To make tow Samples Comparison 4A and Comparison 4B, unless otherwise noted, poly(trimethylene terephthalate) (Sorona® brand, 1.00 IV) was extruded at a maximum temperature of about 260° C. and poly(ethylene terephthalate) ('conventional', semi-dull, Fiber Grade 211 from Intercontinental Polymers, Inc., 0.54 dl/g IV) was extruded at a maximum temperature of 285° C.

The spinneret pack was heated to 280° C. and had 2622 capillaries of circular shape, 0.4 mm in diameter. In the resulting side-by-side round cross-section fibers (about 1–2 dtex), the poly(ethylene terephthalate) was present at 52 wt %, and the poly(trimethylene terephthalate was present at 48 wt % and had an IV of 0.94 dl/g. Fibers were collected from multiple spinning positions by puller rolls operating at 1200–1500 m/min and collected into cans.

Tow from about 50 cans was combined, passed around a feed roll to a first draw roll operated at less than 35° C.,

TABLE 2

| Example | CI, % | CD, % | Free-Fiber Length Retention, % | Tenacity (cN/dtex) | T10 (cN/dtex) | Linear Density (dtex) | Elongation at Break, % | Cardability |
|---|---|---|---|---|---|---|---|---|
| 1A | 21.0 | 43 | 45 | 3.91 | 1.21 | 1.84 | 32.0 | good |
| 1B | 21.0 | 43 | 66 | 3.91 | 1.30 | 1.74 | 35.0 | good |
| 1C | 23.5 | 48 | 47 | 3.98 | 2.56 | 1.73 | 27.0 | good |
| 1D | 20.0 | 42 | 58 | 3.89 | 2.21 | 1.73 | 24.9 | good |
| 1E | 20.5 | 42 | 45 | 4.16 | 2.16 | 1.33 | 24.5 | good |
| 1F | 18.0 | 49 | 68 | 4.07 | 2.59 | 1.16 | 16.8 | good |
| 1G | 22.0 | 52 | nm | 4.02 | 1.82 | 1.27 | 17.8 | good |
| 1H | 16.0 | 37 | nm | 4.42 | 2.84 | 1.34 | 21.0 | good |
| Comp. Example 1 | 22.0 | 55 | 24 | 4.24 | 0.95 | 1.83 | 41.0 | poor |
| Comp. Example 2 | 21.0 | 50 | 24 | 4.02 | 0.92 | 1.86 | 62.0 | poor |

through a steam chest operated at 80° C., and then to a second draw roll. The first draw was about 80% of the total draw applied to the fibers. The drawn tow was about 800,000 denier (888,900 dtex) to 1,000,000 denier (1,111,100 dtex). The drawn tow was heat-treated by contact with a first group of four rolls operated at 110° C., by a second group of four rolls at 140–160° C., and by a third group of four rolls at 170° C. The ratio of roll speeds between the first and second groups of rolls was about 0.91 to 0.99 (relaxation), between the second and third groups of rolls it was about 0.93 to 0.99 (relaxation), and between the third group of rolls and the puller/cooler rolls it was about 0.88 to 1.03 so that the total let-down was 0.86 to 0.89. The final fibers were about 1.46 denier (about 1.62 dtex). A finish spray was applied so that the amount of finish on the tow was 0.15 to 0.35 wt %. The puller/cooler rolls were operated at 35–40° C. The tow was then passed through a continuous, forced convection dryer operating at below 35° C. and collected into boxes under substantially no tension. Additional processing conditions and fiber properties are given in Table 3.

TABLE 3

| Sample | Total Draw Ratio | T10 (cN/dtex) | Tenacity (cN/dtex) | Tow CI, % | Tow CD, % |
|---|---|---|---|---|---|
| Comp. 4A | 3.08 | 1.5 | 4.2 | 24 | 54 |
| Comp. 4B | 2.93 | 1.5 | 4.0 | 7 | 29 |

The tow samples were cut to 1.75 inch (4.4 cm) staple, combined with cotton by intimate blending, carded on a J. D. Hollingsworth card at 60 pounds (27 kg) per hour, and ring-spun to make yarns of various cotton counts.

Example 2

Spun yarns were prepared that comprised bicomponent staple samples made in Example 1 and Comparison Examples 1, 2, 3, and 4. Unless otherwise noted, the cotton was Standard Strict Low Midland Eastern Variety with an average micronaire of 4.3 (about 1.5 denier per fiber (1.7 dtex per fiber)). For the yarns produced using intimate blending, the cotton and the polyester bicomponent staple fiber were blended by loading both into a dual feed chute feeder, which fed a standard textile card. Unless otherwise noted, the amount of bicomponent polyester staple in each yarn was 60 wt %, based on the weight of the fiber. The resulting card sliver was 70 grain/yard (about 49,500 dtex). Six ends of sliver were drawn together 6.5× in each of two or three passes (with appropriate recombining of sliver ends before each pass) to give 60 grain/yard (about 42,500 dtex) drawn sliver which was then converted to roving, unless otherwise noted. The total draft in the roving process was 9.9×. Unless otherwise noted, the bicomponent staple was intimately blended. However, for yarns produced using draw-frame blending, the cotton and bicomponent staple fiber were each carded separately and then combined during the sliver-to-roving drawing step. Unless otherwise noted, the roving was ring-spun on a Saco-Lowell frame using a back draft of 1.35 and a total draft of 29 to give a 22/1 cotton count (270 dtex) spun yarn having a twist multiplier of 3.8 and 17.8 turns per inch (7.0 turns per centimeter). When 100% cotton was so processed, the resulting spun yarn had a total boil-off shrinkage of 5%. Spun yarn properties are presented in Table 4.

TABLE 4

| Spun Yarn Example (Note) | Bico. Fiber Sample | Ne | CV, % | B.O.S., % | Yarn Tenacity, cN/tex | Thins | Thicks | Neps | Yarn Quality Factor |
|---|---|---|---|---|---|---|---|---|---|
| 2A | Example 1A | 22 | 17 | 28 | 12.6 | 48 | 275 | 138 | 605 |
| 2B (1) | Example 1A | 22 | 15 | 32 | 11.9 | 34 | 110 | 41 | 226 |
| 2C (1) | Example 1B | 22 | 15 | 33 | 11.7 | 30 | 153 | 43 | 289 |
| 2D | Example 1C | 22 | 16 | 38 | 14.2 | 26 | 174 | 77 | 314 |
| 2E (2) | Example 1C | 22 | 18 | 38 | 17.3 | 24 | 70 | 10 | 106 |
| 2F | Example 1D | 20 | 13 | nm | 13.9 | 2 | 9 | 11 | 20 |
| 2G (2) | Example 1D | 30 | 15 | nm | 12.9 | 15 | 50 | 47 | 126 |
| 2H | Example 1D | 22 | 16 | 36 | 13.7 | 28 | 155 | 72 | 295 |
| 2I (2, 3) | Example 1D | 22 | 16 | 40 | 17.8 | 16 | 34 | 5 | 48 |
| 2J (3, 4) | Example 1D | 60 | 17 | nm | 16.0 | 125 | 233 | 222 | 606 |
| 2K | Example 1E | 22 | 15 | 36 | 15.3 | 13 | 114 | 62 | 187 |
| 2L | Example 1G | 22 | 15 | 35 | 15.6 | 10 | 106 | 54 | 109 |
| 2M (5) | Example 1G | 22 | 13 | 27 | 16.0 | 1 | 76 | 50 | 64 |
| 2N (6) | Example 1G | 22 | 14 | 29 | 19.3 | 2 | 78 | 49 | 56 |
| 2O (7) | Example 1H | 22 | 17 | 40 | 21.3 | 139 | 116 | 12 | 209 |
| 2P | Example 1H | 22 | 15 | 36 | 15.9 | 17 | 164 | 63 | 233 |
| Comp. 2Q | Comp. Example 1 | 22 | 22 | 30 | 10.9 | 516 | 1324 | 430 | 4594 |
| Comp. 2R | Comp. Example 2 | 22 | 19 | 30 | 11.0 | 194 | 530 | 127 | 1450 |
| Comp. 2S | Comp. Example 3 | 22 | 22 | 36 | 7.9 | 592 | 1156 | 129 | 5148 |
| Comp. 2T | Comp. Example 4A | 12 | 15 | 31 | 12.2 | 5 | 319 | 241 | 705 |
| Comp. 2U | Comp. Example 4B | 12 | 14 | 26 | 12.5 | 2 | 150 | 115 | 301 |
| Comp. 2V | Comp. Example 4A | 20 | 17 | 34 | 11.7 | 25 | 595 | 552 | 1716 |

TABLE 4-continued

| Spun Yarn Example (Note) | Bico. Fiber Sample | Ne | CV, % | B.O.S., % | Yarn Tenacity, cN/tex | Thins | Thicks | Neps | Yarn Quality Factor |
|---|---|---|---|---|---|---|---|---|---|
| Comp. 2W | Comp. Example 4B | 20 | 15 | 28 | 12.5 | 9 | 351 | 398 | 937 |

Notes:
(1) Combed Cotton
(2) Draw-Frame Blending
(3) Pima Cotton
(4) This yarn was spun with a twist multiplier of 4.2 in order to give 32.5 turns per inch (12.8 turns per centimeter).
(5) 35 wt % Bicomponent staple, 40 wt % cotton, 25 wt % T-40A mid-tenacity (4.95 cN/dtex) 1.2 dpf Dacron(R) poly(ethylene terephthalate) staple from DAK Americas
(6) 35 wt % Bicomponent staple, 40 wt % cotton, 25 wt % T-90S high-tenacity (5.65 cN/dtex) 0.9 dpf Dacron(R) poly(ethylene terephthalate) staple from DAK Americas
(7) 100 wt % Bicomponent Staple The data in Table 4 show that the staple fiber of the invention can be used to make a spun yarn of very high quality (low thin and thick regions, low neps, low CV, and overall excellent quality) while retaining high boil-off shrinkage.

What is claimed is:

1. A bicomponent staple fiber comprising poly(ethylene terephthalate) and poly(trimethylene terephthalate), said bicomponent staple fiber having:

a) a substantially oval cross-section shape having an aspect ratio A:B of about 2:1 to about 5:1 wherein A is a fiber cross-section major axis length and B is a fiber cross-section minor axis length;

b) a polymer interface substantially perpendicular to the major axis;

C) a cross-section configuration selected from the group consisting of side-by-side and eccentric sheath-core;

d) a tenacity at 10% elongation of about 1.1 cN/dtex to about 3.5 cN/dtex;

e) a free fiber length retention of about 40% to about 85%, and f) a tow crimp development value of about 30% to 55%.

2. The bicomponent staple fiber of claim 1 having a tenacity at break of about 3.6 cN/dtex to about 6.0 cN/dtex, wherein the aspect ratio A:B is about 2.6:1 to about 3.9:1.

3. The bicomponent staple fiber of claim 1 having a tenacity at 10% elongation of about 2.0 cN/dtex to about 3.5 cN/dtex.

4. The bicomponent staple fiber of claim 1 wherein the aspect ratio A:B is about 3.1:1 to about 3.9:1.

* * * * *